US011551898B2

(12) United States Patent
Hoffmann et al.

(10) Patent No.: US 11,551,898 B2
(45) Date of Patent: Jan. 10, 2023

(54) SWITCHING DEVICE

(71) Applicant: TDK Electronics AG, Munich (DE)

(72) Inventors: Robert Hoffmann, Berlin (DE); Kheng Yu Chong, Johor Bahru (MY)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 17/052,468

(22) PCT Filed: May 3, 2019

(86) PCT No.: PCT/EP2019/061424

§ 371 (c)(1),
(2) Date: Nov. 2, 2020

(87) PCT Pub. No.: WO2019/215047

PCT Pub. Date: Nov. 14, 2019

(65) Prior Publication Data

US 2021/0057178 A1 Feb. 25, 2021

(30) Foreign Application Priority Data

May 7, 2018 (DE) ..... 102018110920.2

(51) Int. Cl.
*H01H 50/54* (2006.01)
*H01H 50/02* (2006.01)
*H01H 50/44* (2006.01)

(52) U.S. Cl.
CPC ..... *H01H 50/546* (2013.01); *H01H 50/023* (2013.01); *H01H 50/44* (2013.01)

(58) Field of Classification Search
CPC .... H01H 50/546; H01H 50/023; H01H 50/44; H01H 2050/025; H01H 50/20
See application file for complete search history.

(56) References Cited

U.S. PATENT DOCUMENTS 3,117,257 A * 1/1964 Stone ..... H01H 50/20 335/262
3,755,766 A * 8/1973 Read, Jr. ..... H01H 51/2209 335/229
3,818,392 A * 6/1974 Guichard ..... H01H 51/287 335/154
3,992,687 A * 11/1976 Schantz ..... H01F 7/12 335/262
4,251,788 A 2/1981 Barthruff et al.
(Continued)

FOREIGN PATENT DOCUMENTS

CN 201171024 Y 12/2008
CN 201698971 U 1/2011
(Continued)

*Primary Examiner* — Bernard Rojas
(74) *Attorney, Agent, or Firm* — Slater Matsil, LLP

(57) ABSTRACT

A switching device is disclosed. In an embodiment a switching device includes at least one stationary contact and a movable contact in a switching chamber configured to contain a gas containing $H_2$, wherein the movable contact is movable by a magnetic armature with a shaft, wherein the shaft projects through an opening in a yoke which is part of a magnetic circuit, and wherein a liner composed of a plastic is arranged in the opening of the yoke, the liner configured to guide the shaft.

23 Claims, 3 Drawing Sheets

(56) References Cited

U.S. PATENT DOCUMENTS

| | | | | |
|---|---|---|---|---|
| 4,563,495 | A * | 1/1986 | Kawaguchi | C08L 77/00 524/514 |
| 4,653,495 | A | 3/1987 | Nanaumi | |
| 5,065,039 | A * | 11/1991 | Isozumi | H01H 51/065 290/48 |
| 5,892,194 | A | 4/1999 | Uotome et al. | |
| 9,035,735 | B2 | 5/2015 | Yano et al. | |
| 10,262,825 | B2 | 4/2019 | Song et al. | |
| 2007/0151965 | A1* | 7/2007 | Mormino, Jr. | B23K 9/1336 219/137.2 |
| 2008/0122562 | A1 | 5/2008 | Bush et al. | |
| 2009/0114622 | A1* | 5/2009 | Bush | H01H 50/023 218/23 |
| 2013/0053284 | A1* | 2/2013 | Jamison | G01N 33/24 507/200 |
| 2015/0053541 | A1* | 2/2015 | Rojko | H01H 3/46 200/335 |
| 2016/0189901 | A1* | 6/2016 | Tsutsumi | H01H 50/36 335/84 |
| 2019/0019643 | A1 | 1/2019 | Bobert | |

FOREIGN PATENT DOCUMENTS

| | | | |
|---|---|---|---|
| CN | 105719908 | A | 6/2016 |
| CN | 205542615 | U | 8/2016 |
| DE | 3824801 | A1 | 1/1990 |
| DE | 69714895 | T2 | 12/2002 |
| DE | 112013002533 | T5 | 3/2015 |
| DE | 102016107127 | A1 | 8/2017 |

* cited by examiner

SWITCHING DEVICE

This patent application is a national phase filing under section 371 of PCT/EP2019/061424, filed May 3, 2019, which claims the priority of German patent application 102018110920.2, filed May 7, 2018, each of which is incorporated herein by reference in its entirety.

TECHNICAL FIELD

A switching device is described.

BACKGROUND

The switching device is embodied, in particular, as a remotely operated, electromagnetically acting switch which can be operated by electrically conductive current. The switching device can be activated via an electrical control circuit and can switch an electrical load circuit. In particular, the switching device can be designed as a relay or as a contactor, in particular as a power contactor. The switching device may particularly preferably be designed as a gas-filled power contactor.

One possible application for switching devices of this kind, in particular power contactors, is opening and isolating electrical battery circuits, for example in motor vehicles such as electrically or partially electrically driven motor vehicles. These may be, for example, purely battery-operated vehicles (BEV: "battery electric vehicle"), hybrid electric vehicles which can be charged via a power outlet or charging station (PHEV: "plug-in hybrid electric vehicle") and hybrid electric vehicles (HEV). In general here, both the positive and the negative contact of the battery are isolated using a power contactor. This disconnection is performed in normal operation for example when the vehicle is at a standstill and also in the event of a disturbance such as an accident or the like. The main task of the power contactor here is to switch the vehicle to a de-energized state and to interrupt the flow of current.

A core feature of contactors of this kind is the expected service life, expressed in switching operations, that is to say switch-on and switch-off processes. Current requirements are greater than 1 million switching operations. It is therefore important to select suitable materials, in particular for the moving components in the interior, in order to reduce or to avoid abrasion effects which shorten the service life. In the case of gas-filled contactors, the gas atmosphere places particular demands on the usable materials since not all materials are suitable for being introduced into, for example, atmospheres containing large amounts of hydrogen. Furthermore, it is desirable to not hamper gas exchange or the movement of gas during assembly and during operation, in particular in order that the movable core is not broken during operation.

Known gas-filled contactors which are based on ceramic switching chambers use metal/metal sliding bearings for guiding the moving components. A widely used material mixture is stainless steel as shaft material against pure iron as yoke and core material. However, the friction between these two material partners produces abraded metal, which can clog the mechanical system, after a few 100,000 switching operations. This is also the reason why conventional contactors usually have only service lives of 200,000 switching operations.

A further problem in guiding the moving system with metal/metal bearings are the required very tight fits. These tight fits adversely affect gas exchange during assembly since a small pump cross section leads to a prolonged filling time, and during operation since gas through the small pump cross section, owing to the tight fit, cannot follow the movement of the mechanical system and leads to delaying of the switching process.

SUMMARY

Embodiments provide a switching device, particularly preferably a switching device in which described disadvantages can be reduced or even prevented.

According to one embodiment, a switching device has at least one stationary contact and at least one movable contact. The at least one stationary contact and the at least one movable contact are intended and designed to switch on and switch off an electrical load circuit which can be connected to the switching device. The movable contact can move in the switching device in a corresponding manner between a non-switched-through state and a switched-through state of the switching device in such a way that the movable contact is at a distance from the at least one stationary contact and is therefore DC-isolated in the non-switched-through state of the switching device and is in mechanical contact with the at least one stationary contact and is therefore electrically conductively connected to the at least one stationary contact in the switched-through state. The switching device particularly preferably has at least two stationary contacts which are arranged in the switching device in a manner isolated from one another and which in this way can be electrically conductively connected to one another or electrically isolated from one another by the movable contact depending on the state of the movable contact.

According to a further embodiment, the switching device has a housing in which the movable contact and the at least one stationary contact or the at least two stationary contacts are arranged. The movable contact can be arranged, in particular, entirely in the housing. The fact that a stationary contact is arranged in the housing can mean, in particular, that at least the contact region of the stationary contact, which is in mechanical contact with the movable contact in the switched-through state, is arranged within the housing. For connection of a supply line of an electrical circuit which is to be switched by the switching device, electrical contact can be made with a stationary contact, which is arranged in the housing, from the outside, that is to say from outside the housing. To this end, a stationary contact which is arranged in the housing can project out of the housing by way of one portion and have a connection facility for a supply line outside the housing.

According to a further embodiment, the contacts are arranged in a gas atmosphere in the housing. This can mean, in particular, that the movable contact is arranged entirely in the gas atmosphere in the housing, and that furthermore at least portions of the stationary contact or contacts, for example the contact region or regions of the stationary contact or contacts, are arranged in the gas atmosphere in the housing. The switching device can accordingly particularly preferably be a gas-filled switching device such as a gas-filled contactor.

According to a further embodiment, the contacts, that is the movable contact entirely and at least portions of the stationary contact or contacts, are arranged in a switching chamber within the housing, in which switching chamber the gas, that is to say at least a portion of the gas atmosphere, is located. The gas can preferably have an $H_2$ content of at least 50%. In addition to hydrogen, the gas can include an inert gas, particularly preferably $N_2$ and/or one or more noble gases.

According to a further embodiment, the movable contact can be moved by means of a magnetic armature. To this end, the magnetic armature can have, in particular, a shaft which, at one end, is connected to the movable contact in such a way that the movable contact can be moved by means of the shaft, that is to say, when the shaft moves, said movable contact is likewise moved by said shaft. The shaft can, in particular, project through an opening in the switching chamber into the switching chamber. The magnetic armature can be movable by a magnetic circuit in order to affect the above-described switching processes. To this end, the magnetic circuit can have a yoke which has an opening through which the shaft of the magnetic armature projects. The shaft can preferably include stainless steel or consist of stainless steel. The yoke can preferably include pure iron or a low-doped iron alloy or consist of pure iron or a low-doped iron alloy.

According to a further embodiment, a liner is arranged in the opening of the yoke. The liner includes a plastic and is designed, in particular, for guiding the shaft. To this end, the liner can have a guide opening, in particular a cylindrical guide opening, in which the shaft is arranged. In particular, the shaft in the guide opening can project through the liner. The guide opening and the shaft can have a very tight fit in order to allow the shaft to be accurately guided. In other words, the guide opening can have a diameter which is only slightly larger than a diameter of the shaft, so that the shaft can move substantially only along the direction of extent of the guide opening and twisting of the shaft in the guide opening can be avoided. The shaft can particularly preferably be guided free of contact with the yoke in the liner, so that abrasion between the shaft and the yoke can be prevented.

According to a further embodiment, the liner is fastened in the opening of the yoke by a press fit. As a result, the liner can be fixed in the opening of the yoke. In particular, the liner can have an outer surface which is at least partially in contact with an inner wall of the opening of the yoke.

According to a further embodiment, at least one channel is formed in the outer surface of the liner. The channel can run from a side that is averted from the movable contact to a side of the liner that faces the movable contact. In the region of the duct, the outer surface of the liner can be spaced apart from the opening of the yoke, so that an intermediate space which extends through the opening of the yoke is formed between the opening inner wall and the liner outer surface, said intermediate space allowing gas exchange through the opening of the yoke. Since the shaft is guided in the guide opening of the liner, the at least one channel and the shaft are separated from one another and the at least one channel does not have any negative effects on shaft guidance. Therefore, shaft guidance and gas exchange are separated from one another. The at least one channel can particularly preferably run parallel to the shaft.

According to a further embodiment, there is a plurality of channels in the outer surface of the liner. The channels can be designed as described above. In particular, the channels can be arranged on the outer surface of the liner at regular intervals around the guide opening and therefore around the shaft. Furthermore, all channels can particularly preferably run parallel to the shaft. Between the channels, the outer surface of the liner can, as described above, be in contact with the inner wall of the opening of the yoke and in this way effect the described press fit.

According to a further embodiment, the liner includes a hydrogen-compatible plastic. Furthermore, the plastic can exhibit the lowest possible level of friction, in particular with respect to the shaft material. In particular, the liner can include a polyethylene (PE), a gas-filled polybutylene terephthalate (PBT) and/or a polyether ether ketone (PEEK). The liner can particularly preferably be formed from a PEEK. PEEK has the advantage that it has a melting point of 335° C. and is therefore advantageously resistant to high temperatures in respect of the temperatures which usually occur in gas-filled contactors.

Using the described liner, it may be possible for the service life of the switching device to be able to be increased in comparison to a usual design without the liner from a few 100,000 switching operations to several million switching operations. In addition, the liner, by way of including a plastic and particularly preferably being formed from plastic, can additionally be equipped with one or more channels in the outer surface, which channels act as bypasses for the gas in the switching device and therefore improve gas exchange within the switching device during operation of the switching device, in a simple manner as early as during the manufacturing process, for example by means of injection molding.

BRIEF DESCRIPTION OF THE DRAWINGS

Further advantages, advantageous embodiments and developments can be found in the exemplary embodiments described below in conjunction with the figures, in which.

DETAILED DESCRIPTION OF ILLUSTRATIVE EMBODIMENTS

In the exemplary embodiments and figures, identical, similar or identically functioning elements may each be provided with the same reference signs. The elements illustrated and their proportions with respect to each other should not be considered to be true to scale, instead individual elements such as, for example, layers, parts, components and regions may be illustrated to be disproportionately large for the purposes of improved presentability and/or for the purposes of better understanding.

Figure 1A:
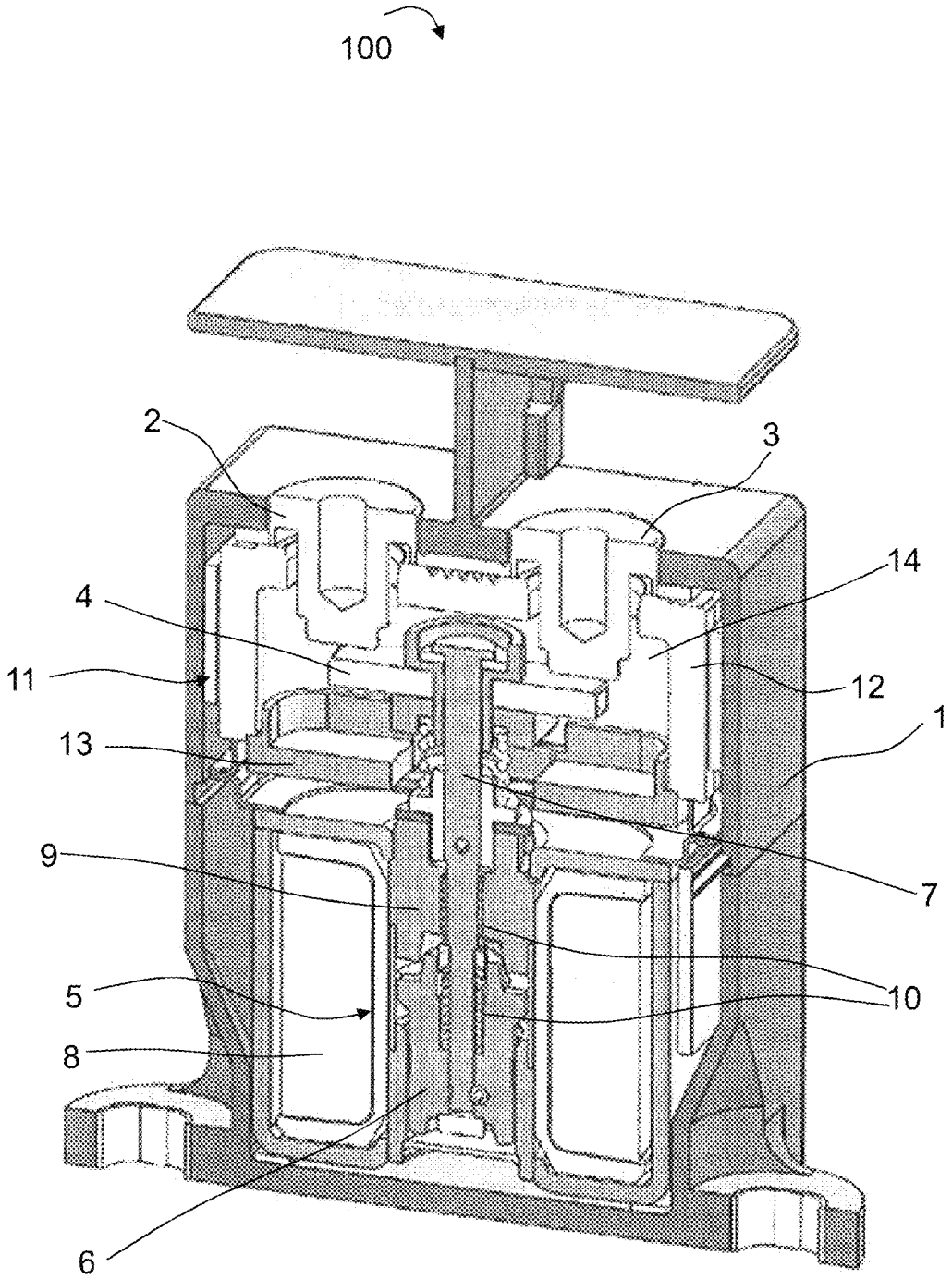
FIGS. 1A and 1B show schematic illustrations of an example of a switching device.
Figure 1B:
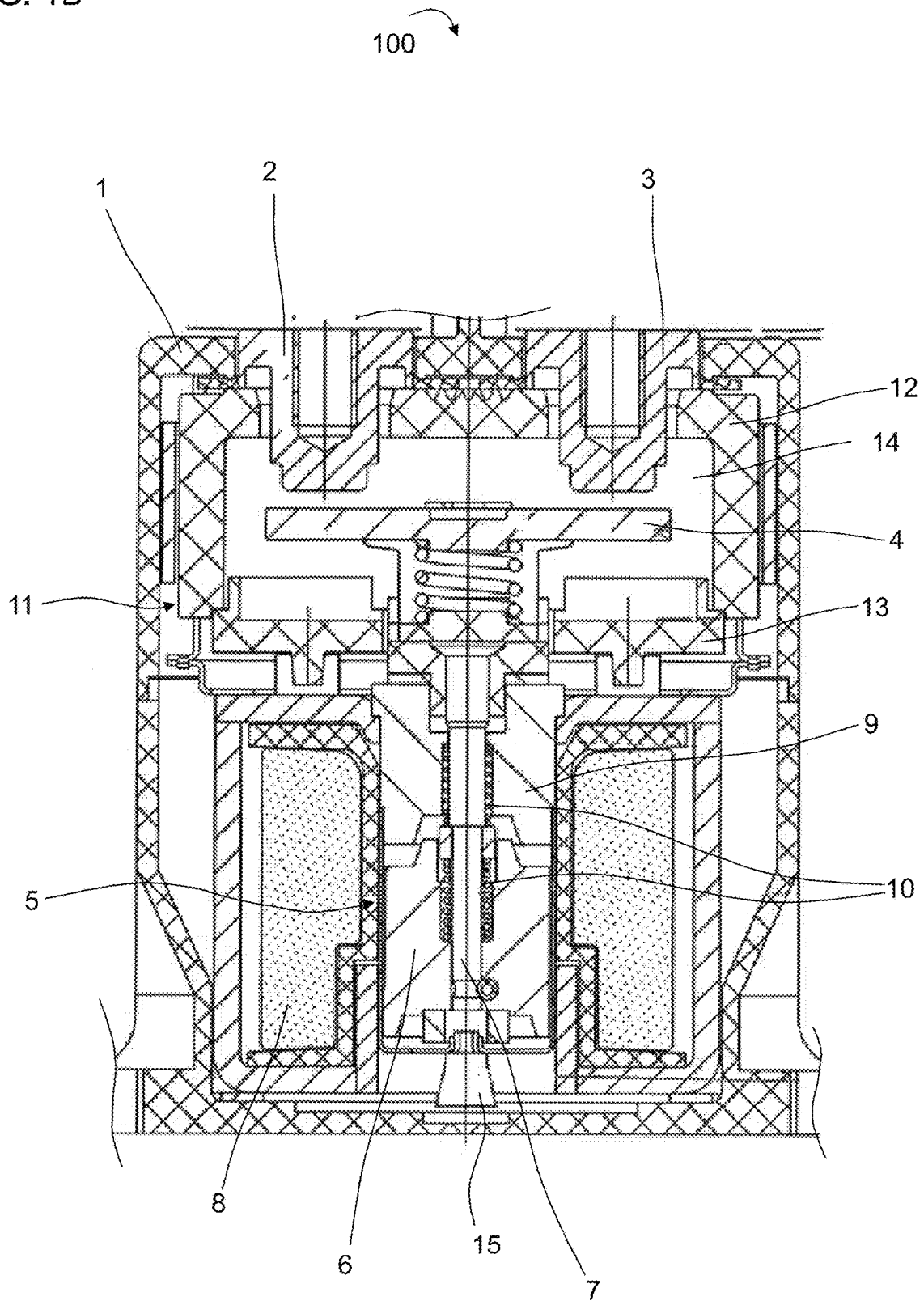

FIGS. 1A and 1B show a switching device 100 which can be used, for example, for switching high electric currents and/or high electric voltages and which can be a relay or a contactor, in particular a power contactor. FIG. 1A shows a three-dimensional sectional illustration, while a two-dimensional sectional illustration is illustrated in FIG. 1B. The description which follows relates equally to FIGS. 1A and 1B. The geometries shown are to be understood merely by way of example and in a non-limiting manner, and can also be designed in an alternative manner.

The switching device 100 has two stationary contacts 2, 3 and a movable contact 4 in a housing 1. The movable contact 4 is designed as a contact plate. The stationary contacts 2, 3 together with the movable contact 4 form the switching contacts. The housing 1 serves primarily as protection against contact with the components which are arranged in the interior and includes or consists of a plastic, for example PBT or glass-filled PBT. The contacts 2, 3, 4 can, for example, contain or consist of copper, a copper alloy or a mixture of copper with at least one further metal, for example tungsten, nickel and/or chromium.

FIGS. 1A and 1B show the switching device 100 in an inoperative state in which the movable contact 4 is spaced apart from the stationary contacts 2, 3, so that the contacts 2, 3, 4 are DC-isolated from one another. The design shown for the switching contacts and in particular the geometry thereof is to be understood purely by way of example and in a non-limiting manner. As an alternative, the switching contacts can also be designed differently. For example, it may be possible for just one of the switching contacts to be designed to be stationary.

The switching device 100 has a movable magnetic armature 5 which substantially performs the switching movement. The magnetic armature 5 has a magnetic core 6, for example comprising or consisting of a ferromagnetic material. Furthermore, the magnetic armature 5 has a shaft 7 which is guided through the magnetic core 6 and, at one shaft end, is fixedly connected to the magnetic core 6. At the other shaft end which is situated opposite the magnetic core 6, the magnetic armature 5 has the movable contact 4 which is likewise connected to the shaft 7. The shaft 7 can preferably be manufactured with or from stainless steel.

The magnetic core 6 is surrounded by a coil 8. A current flow, which can be introduced from outside, in the coil 8 generates a movement of the magnetic core 6 and therefore of the entire magnetic armature 5 in an axial direction until the movable contact 4 makes contact with the stationary contacts 2, 3. The magnetic armature 5 therefore moves from a first position, which corresponds to the inoperative state and simultaneously to the isolating, that is to say non-switched-through, state, to a second position, which corresponds to the active, that is to say switched-through, state. In the active state, the contacts 2, 3, 4 are electrically conductively connected to one another. In another embodiment, the magnetic armature 5 can alternatively also execute a rotary movement. The magnetic armature 5 can be designed, in particular, as a tie rod or as a hinged armature. If the current flow in the coil 8 is interrupted, the magnetic armature 5 is moved back to the first position by one or more springs 10. The switching device 100 is then back in the inoperative state in which the contacts 2, 3, 4 are open.

When the contacts 2, 3, 4 are opened, an arc may be formed which can damage the contact areas. As a result, there may be the risk of the contacts 2, 3, 4 remaining "stuck" to one another owing to welding caused by the arc and no longer being separated from one another. In order to prevent the formation of arcs of this kind or at least to assist in quenching of arcs which occur, the contacts 2, 3, 4 are arranged in a gas atmosphere, so that the switching device 100 is designed as a gas-filled relay or gas-filled contactor. To this end, the contacts 2, 3, 4 are arranged within a switching chamber 11, formed by a switching chamber wall 12 and a switching chamber base 13, in a hermetically sealed portion of the housing 1. The housing 1 and, in particular, the hermetically sealed portion of the housing 1 completely surround the magnetic armature 5 and the contacts 2, 3, 4. The hermetically sealed portion of the housing 1 and therefore also the switching chamber 11 are filled with a gas 14. The gas 14, which can be introduced via a gas-filling port 15 within the scope of the production of the switching device 100, can particularly preferably contain hydrogen, for example 50% or more $H_2$ in an inert gas or even 100% $H_2$ since hydrogen-containing gas can promote quenching of arcs. Furthermore, there may be so-called blowout magnets (not shown) within or outside the switching chamber 11, that is to say permanent magnets which can extend the arc path and therefore improve quenching of the arcs. The switching chamber wall 12 and the switching chamber base 13 can be manufactured, for example, with or from a metal oxide, such as $Al_2O_3$.

FIGS. 1A and 1B show conventional guidance of the shaft 7, which projects through an opening in the switching chamber base 13 into said switching chamber base, and therefore of the magnetic armature 5. To this end, there is a yoke 9 which preferably includes pure iron or a low-doped iron alloy or consists of pure iron or a low-doped iron alloy and which forms part of the magnetic circuit. The yoke 9 has an opening in which the shaft 7 is guided. As described in the general part, the friction between the shaft 7 and the yoke 9 can lead to abraded material which can clog the mechanical system. Furthermore, the accurate fit of the yoke opening with respect to the shaft 7 hampers gas exchange within that portion of the housing which is filled with gas, and this can lead to delays in the switching processes.

Figure 2A:
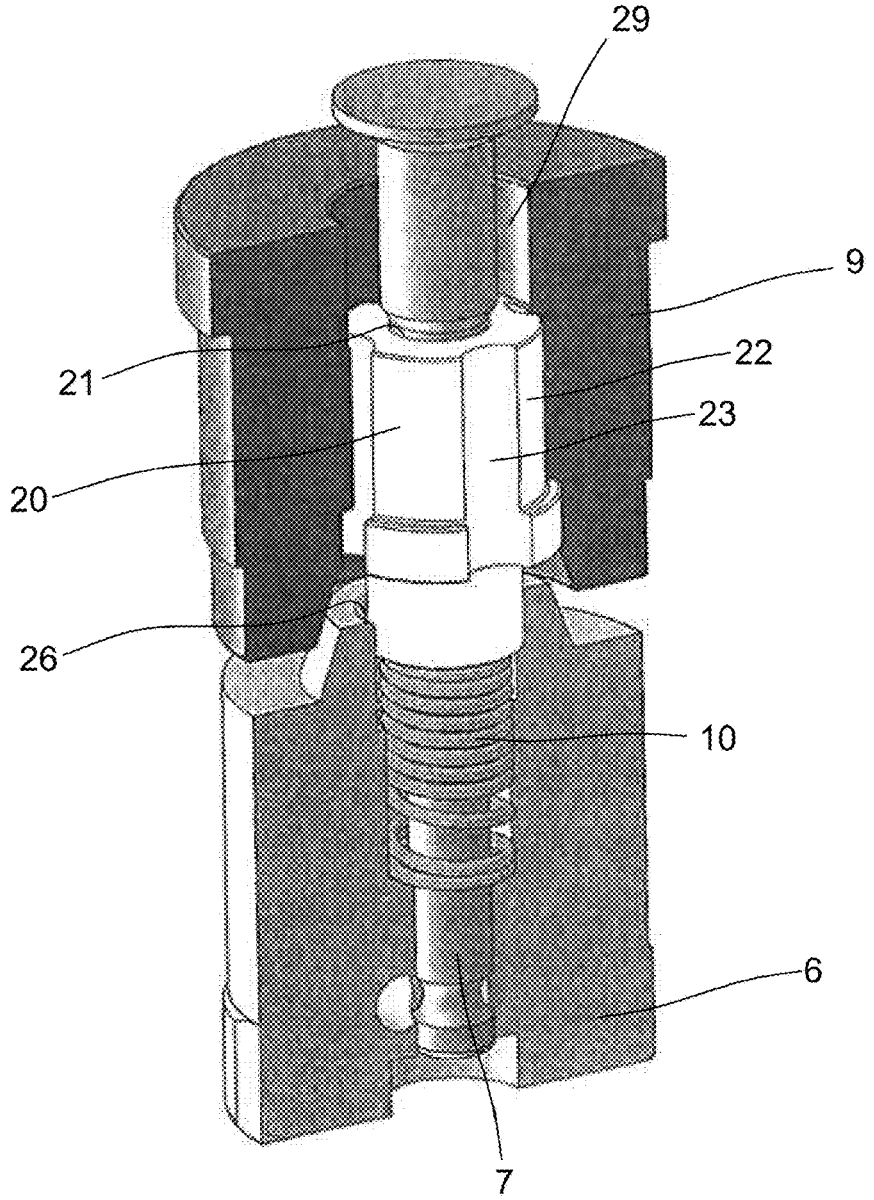
FIGS. 2A and 2B show schematic illustrations of a portion of a switching device according to an exemplary embodiment.
Figure 2B:
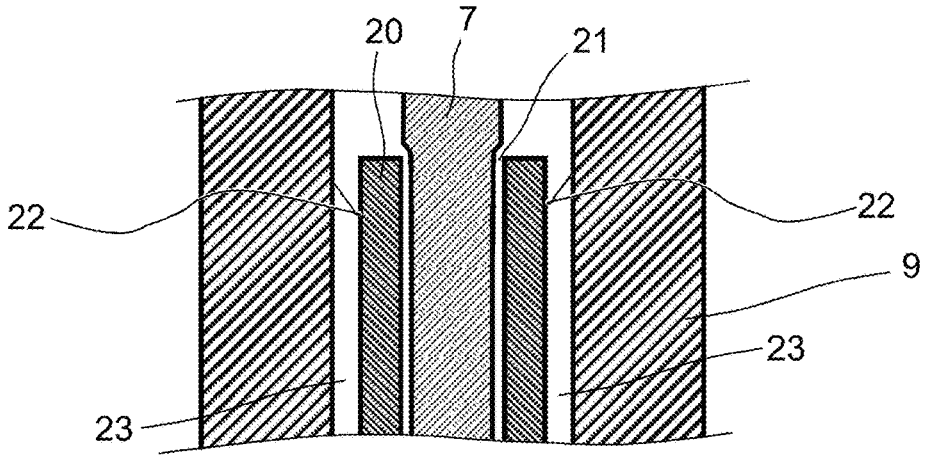

FIGS. 2A and 2B show an exemplary embodiment of the guidance of the shaft 7 using a three-dimensional illustration and in a sectional illustration of those parts of the switching device which are involved in the guidance, wherein the description which follows relates equally to both figures. Components and features of the switching device which are not shown and/or described in conjunction with FIGS. 2A and 2B can be designed as described in conjunction with FIGS. 1A and 1B. For reasons of improved identification, the magnetic core 6 and the yoke 9 are illustrated in cut-open form in FIG. 2A.

In comparison to the usual guidance of the shaft 7 through the yoke 9, in the exemplary embodiment shown the yoke 9 has an opening 29 in which a liner 20 is arranged. The liner 20 includes a low-friction, hydrogen-compatible plastic, in particular PE, glass-filled PBT and/or preferably PEEK. The liner 20 is particularly preferably formed from PEEK which, with a melting point of 335° C., is advantageously resistant to high temperatures in respect of the temperatures which usually occur in gas-filled contactors. The shape described below of the liner 20 can be produced by a manufacturing method such as injection molding for example.

In order to guide the shaft 7, the liner 20 has a guide opening 21 which is of, in particular, cylindrical design and in which the shaft is arranged, so that the shaft 7 in the guide opening 21 projects through the liner 20. The guide opening 21 and the shaft 7 preferably have a very tight fit in order to allow precise guidance of the shaft 7. The guide opening 21 therefore has a diameter which is only very slightly larger than the diameter of the shaft 7. In FIG. 2B, the diameter of the guide opening 21 is illustrated to be disproportionately large in comparison to the shaft diameter for reasons of clarity. As can be clearly identified, the shaft 7 is guided free of contact with the yoke 9 in the liner 20. Owing to the non-existent contact between the shaft 7 and the yoke 9, abrasion between the shaft 7 and the yoke 9 can therefore be prevented.

The liner 20 is fastened in the opening 29 of the yoke 9 by a press fit, wherein the liner 20 does not necessarily have to fill the entire opening 29 of the yoke 9, as shown. To this end, the liner 20 has an outer surface 22 which is at least partially in contact with the inner wall of the opening 29 of the yoke 9. Owing to the press fit, the liner 20 is fixed in the opening 29 of the yoke 9 independently of the movement of the shaft 7.

The liner 20 can, by way of the entire outer surface 22 and/or over the entire circumference, bear against the inner surface of the opening 29 of the yoke 9. However, it may be more advantageous when, as is shown in FIGS. 2A and 2B, at least one channel 23 is formed in the outer surface 22. The at least one channel 23 can particularly preferably run parallel to the shaft 7. The at least one channel 23 preferably runs from a side that is averted from the movable contact to a side of the liner 20 that faces the movable contact, and forms an intermediate space, which extends through the opening 29 of the yoke 9, between the inner wall of the opening 29 and the outer surface 22 of the liner 20, said intermediate space allowing gas exchange through the opening 29 of the yoke 9. When the magnetic armature moves during a switching process of the switching device, gas can therefore flow through a channel 23 of this kind and therefore follow the movement of the moving parts, so that no positive pressure or vacuum which could lead to a delay in the switching process can form in a subregion in the gas volume.

In the exemplary embodiment shown, the liner 20 has a plurality of channels 23 in the outer surface 22. Four channels 23 are shown purely by way of example, but there may also be more or fewer channels. The channels 23 are, as shown, preferably arranged at regular intervals on the outer surface 22 of the liner 20 around the guide opening 21 and therefore around the shaft 7 and all run parallel to the shaft 7. Between the channels 23, the outer surface 22 of the liner 20, which outer surface is in contact with the inner wall of the opening 29 of the yoke 9, as described above, ensures a press fit and therefore fixing of the liner 20 in the opening 29 of the yoke 9.

As is further shown in FIG. 2A, the liner 20 can project into the opening 26 in the magnetic core 6, in which opening the shaft 7 is fastened, in at least one switching state of the switching device and preferably permanently. In particular, the liner 20 can also form a stop for the spring 10.

The features and exemplary embodiments described in the in conjunction with the figures can be combined with one another according to further exemplary embodiments, even if not all combinations have been explicitly described. Furthermore, the exemplary embodiments described in conjunction with the figures may alternatively or additionally include further features in accordance with the description in the general part.

The invention is not restricted to the exemplary embodiments by the description on the basis of said exemplary embodiments. Rather, the invention encompasses any novel feature and any combination of features, which in particular includes any combination of features in the patent claims, even if this feature or this combination is not itself explicitly specified in the patent claims or exemplary embodiments.

The invention claimed is:

1. A switching device comprising:

at least one stationary contact and a movable contact in a switching chamber configured to contain a gas containing $H_2$, wherein the movable contact is movable by a magnetic armature with a shaft, wherein the shaft projects through an opening in a yoke which is part of a magnetic circuit, wherein a liner composed of a plastic is arranged in the opening of the yoke, the liner configured to guide the shaft, wherein the liner has an outer surface which is partially in contact with an inner wall of the opening of the yoke and in which at least one channel is located, and wherein the at least one channel and the shaft are separated from one another.

2. The switching device according to claim 1, wherein the liner includes a hydrogen-compatible plastic.

3. The switching device according to claim 1, wherein the liner includes a polyethylene, a glass-filled polybutylene terephthalate, and/or a polyether ether ketone.

4. The switching device according to claim 1, wherein the liner is formed from a polyether ether ketone.

5. The switching device according to claim 1, wherein the liner has a cylindrical guide opening in which the shaft is arranged.

6. The switching device according to claim 1, wherein the liner is fastened in the opening of the yoke by a press fit.

7. The switching device according to claim 1, wherein the at least one channel runs parallel to the shaft.

8. The switching device according to claim 1, wherein the at least one channel runs from a side that is facing away from the movable contact to a side of the liner that faces the movable contact.

9. The switching device according to claim 1, wherein the outer surface of the liner comprises a plurality of channels.

10. The switching device according to claim 1, wherein the shaft is configured to be guided in the liner free of contact with the yoke.

11. The switching device according to claim 1, wherein the shaft, with a shaft end, projects into an opening in a magnetic core, and the liner projects into the opening in the magnetic core in at least one switching state of the switching device.

12. The switching device according to claim 1, wherein the yoke includes pure iron or a low-doped iron alloy.

13. The switching device according to claim 1, wherein the shaft includes stainless steel.

14. The switching device according to claim 1, wherein the gas has an $H_2$ content of at least50%.

15. A switching device comprising:

at least one stationary contact and a movable contact in a switching chamber configured to contain a gas containing $H_2$, wherein the movable contact is movable by a magnetic armature with a shaft, wherein the shaft projects through an opening in a yoke which is part of a magnetic circuit, wherein a liner composed of a plastic is arranged in the opening of the yoke, the liner configured to guide the shaft, and wherein the liner is fastened in the opening of the yoke independently of a movement of the shaft by a press fit.

16. The switching device according to claim 15, wherein the liner includes a hydrogen-compatible plastic.

17. The switching device according to claim 15, wherein the liner includes a polyethylene.

18. The switching device according to claim 15, wherein the liner includes a glass-filled polybutylene terephthalate.

19. The switching device according to claim 15, wherein the liner includes a polyether ether ketone.

20. The switching device according to claim 15, wherein the liner has a cylindrical guide opening in which the shaft is arranged.

21. A switching device comprising:

at least one stationary contact and a movable contact in a switching chamber configured to contain a gas containing $H_2$, wherein the movable contact is movable by a magnetic armature with a shaft, wherein the shaft projects through an opening in a yoke which is part of a magnetic circuit, wherein a liner composed of a plastic is arranged in the opening of the yoke, the liner configured to guide the shaft, and wherein the shaft, with a shaft end, projects into an opening in a magnetic core, and the liner projects into the opening in the magnetic core in at least one switching state of the switching device.

22. The switching device according to claim 21, wherein the liner permanently projects into the opening in the magnetic core.

23. The switching device according to claim 21, further comprising a spring completely arranged inside the opening in the magnetic core.

* * * * *